United States Patent [19]

Förster

[11] 4,058,782

[45] Nov. 15, 1977

[54] METHOD AND APPARATUS FOR COMPENSATION OF INTERFERENCE MAGNETIC FIELDS

[76] Inventor: Friedrich M. O. Förster, Grathwohlstrasse 4, D-7410 Reutlingen, Germany

[21] Appl. No.: 609,583

[22] Filed: Sept. 2, 1975

[30] Foreign Application Priority Data

Sept. 12, 1974 Germany ..... 2443672

[51] Int. Cl.[2] ..... H01F 13/00

[52] U.S. Cl. ..... 335/219; 33/358; 361/146

[58] Field of Search ..... 33/356, 357, 358, 359; 317/157.5; 335/302, 304, 301, 219; 361/146

[56] References Cited

U.S. PATENT DOCUMENTS

| | | | |
|---|---|---|---|
| 438,777 | 10/1890 | Merrill | 33/358 |
| 769,870 | 9/1904 | Morrison | 33/358 |
| 1,922,864 | 8/1933 | Rhea | 33/358 |
| 1,977,954 | 10/1934 | Reichel | 33/357 |
| 1,982,405 | 11/1934 | Titterington | 33/357 |
| 2,011,775 | 8/1935 | Reichel et al. | 33/359 |
| 2,048,920 | 7/1936 | Colvin | 33/359 |
| 2,417,864 | 3/1947 | Dinsmore | 33/359 |
| 2,528,446 | 10/1950 | McConnell | 317/157.5 |
| 3,110,282 | 11/1963 | Foerster | 317/157.5 |
| 3,530,704 | 9/1970 | Wallace | 33/358 |

*Primary Examiner*—Harold Broome
*Attorney, Agent, or Firm*—George J. Netter

[57] ABSTRACT

Compensating magnets are located on the article being tested which are adjustable to provide a range of magnetic moments. In a first version, each compensating magnet consists of an annular permanent magnet received on a rod-like element positioned on the surface of the article, which magnet is adjustable with respect to the article surface. In a second version, the magnet is located at a fixed spacing with respect to the article surface and a shunt is adjustable to vary the compensating field.

15 Claims, 3 Drawing Figures

METHOD AND APPARATUS FOR COMPENSATION OF INTERFERENCE MAGNETIC FIELDS

The invention relates generally to a method and apparatus for stable compensation of the magnetic interference fields produced on magnetization of a magnetizable article by the vertical component of the earth's magnetic field in the vicinity of the article, in which a compensation moment opposite to the magnetic moment induced in the article by the vertical component is produced through at least one compensating magnet and the article is further subjected to a vertically directed alternating magnetic field with decaying amplitude.

BACKGROUND OF THE INVENTION

A method of this general type is known from German Pat. No. 977,886 of the applicant and is of proven value, especially in the compensation of so-called non-magnetic articles. What is meant by this are articles and apparatus of largely non-magnetic design, i.e., combustion engines or electric motors in non-magnetic housings, such as are frequently intended for installation in ships or tanks.

Because of the danger or triggering magnetic mines or other magnetically controlled weapons, it is often necessary to keep the interference caused by the earth's magnetic field in the vicinity of vehicles of this type as low as possible. In this connection, for reasons which are explained in detail in the above-cited patent, the vertical component of the earth's magnetic field plays a decisive role. Special measures for suppressing the magnetic interference field produced from the vertical component of the earth's field on ferromagnetic components therefore is often necessary. In the above-mentioned engines or motors with housings of non-magnetic material, each individual ferromagnetic component of the engine or motor, such as tie-bars, cylinder head screws, etc., was compensated according to the above-mentioned patent prior to being installed in the non-magnetic housing.

To accomplish this, the component to be compensated was first demagnetized in a zero field to remove any permanent magnetization present. The zero field was produced by eliminating the earth's magnetic field in the vicinity of the component by means of a wire loop producing an appropriately dimensioned opposite field. The component was then placed in contact with a permanent magnet, whose magnetic moment was opposed to the moment induced in the component from the vertical components of the earth's field and dimensioned in such a manner as to result in an overcompensation. Then, the component was subjected to the influence of a decaying alternating magnetic field while the component was located in its normal position within the earth's magnetic field. Under the influence of this decaying alternating field, which anticipates the subsequent mechanical vibration of the component, the permanent magnetization of the component changed in the direction of the idealization curve, i.e., became greater, under the influence of the vertical component of the earth's field, so that with the stabilized magnetization value now achieved, approximate compensation through the permanent magnets was produced. If the compensation was still not sufficient, the treatment in the decaying alternating magnetic field was repeated with a somewhat greater initial amplitude of the alternating field. In this connection, it was only necessary to insure that the initial field amplitude was always large enough to correspond to the maximum mechanical vibration expected in actual service. The components compensated with high stability in this manner were then installed in the non-magnetic housing.

However it has so far not been possible to provide stable compensation of the vertical components of the magnetization of combustion engines, which are fabricated entirely of steel and which also have a housing of cast steel.

SUMMARY OF THE INVENTION

In the practice of the method of the subject invention, a plurality of compensating magnets are located on the article which magnets can be adjustable to provide a range of magnetic moments. In a first version, each compensating magnet consists of an annular permanent magnet received on a rod-like element positioned on the surface of the article which magnet is adjustable with respect to the article surface. In a second version, the magnet is located at a fixed spatial relation to the article surface and a shunt is adjusted to vary the compensating field.

DESCRIPTION OF A PREFERRED EMBODIMENT

Figure 1:
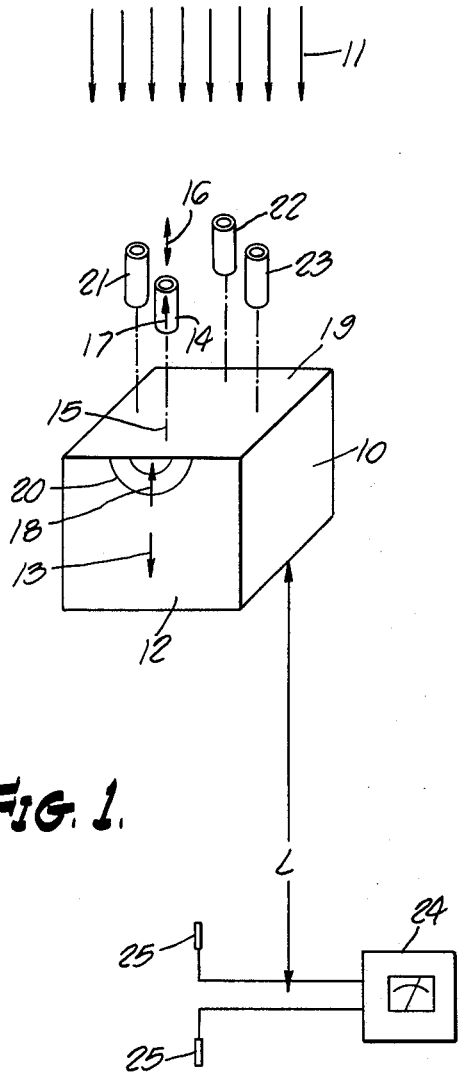
FIG. 1 shows a schematic representation of the compensation of an article.

In FIG. 1, compensation of the magnetic moments induced in an article 10 from the vertical components 11 of the earth's magnetic field is shown in a simplified manner. The article 10 is understood to be apparatus such as a combustion engine with a housing of a ferromagnetic material. In the front housing wall 12, the magnetic moment 13 is induced from the vertical components 11 of the earth's magnetic field. An annular compensating magnet 14 is arranged above apparatus 10 and can be moved vertically along path 15 in accordance with arrow 16. In an equally meritorious alternative, compensating magnet 14 is fixedly arranged, and its compensating effect is varied by altering a compensating magnet shunt. Compensating magnet 14 is schematically represented by the magnetic moment 17 which induces a magnetic countermoment 18 in the upper section of housing wall 12, opposed to moment 13. The closer compensating magnet 14 is moved to surface 19 of the housing or the weaker a compensating magnet shunt is set, the greater the magnetized area 20 of the housing wall is and the greater the magnitude of magnetic countermoment 18 is, so that compensation, as well as overcompensation, of moment 13 through countermoment 18 is possible. The centres of gravity of countermoment 18 and moment 13 to be compensated thereby are arranged very close one to the other geometrically, as the countermoment is shifted into the housing wall. This not only provides good coincidence of the paths of the compensating magnetic field and the magnetic field to be compensated, but also provides high quality compensation. The other housing walls can also be compensated in the same manner by means of further compensating magnets 21, 22, 23.

The formation of a magnetic interference field and its degree of compensation $\delta k$ is monitored by a differential magnetic field meter 24 having a pair of probes 25. The distance L between the pair of probes 25 and the article or apparatus housing must be at least large enough for it to act like a magnetic dipole at the location of the probes. A distance L, which corresponds to $1\frac{1}{2}$ times the height of the housing, is generally sufficient for this purpose. The degree of compensation is $$\delta k = [1 - (H_{int.comp.}/H_{int.})] \times 100\%,$$

where $H_{int.comp}$ is the interference field with compensation and $H_{int.}$ is the interference field without compensation.

Compensation of an entire housing can now be performed in the following manner. First, after demagnetization of the housing in a zero field as described, compensating magnets 14, 21, 22, 23 are then placed on the housing and set at a given, relatively great distance from the housing surface 19. This is followed by a treatment in the decaying alternative magnetic field of a further current loop placed about the housing, which is not shown in FIG. 1 for reasons of clarity. At the same time, the housing is also subjected to the influence of the earth's magnetic field. After the alternating field treatment, through which countermoments larger than the original countermoments 18 aged into the housing walls, the degree of compensation is determined. The compensating magnets are then moved closer, the alternating field treatment is repeated, and the degree of compensation is measured again. This may have to be repeated several times until the desired degree of compensation has been attained.

In the above described manner, it is also possible to produce a diagram or graph in which the degree of compensation attained at each distance is indicated at different locations of the compensating magnets from the housing. It is recommended that a diagram of this type be made in all cases of compensation of the prototype of an article or apparatus if a number of further apparatus of the same type are to be compensated subsequently. It is also practical to include values in the diagram which correspond to an overcompensation of the apparatus.

The following will show how compensation of the empty housing of an apparatus is sufficient in many cases, and the subsequent installation of ferromagnetic components does not significantly alter the required degree of compensation. A screening effect for those components to be installed in the interior of the housing can be noticed in two ways, and can be calculated from the wall thickness, outside dimensions and permeability of the housing material: Firstly, the earth's magnetic field is weaker in the interior of the housing, and secondly, the effect of the magnetic moment of the installed components induced from the remainder of the earth's field is weaker on the outside. In addition, that portion of the earth's vertical field component which penetrates through the housing wall is further weakened in the interior of the housing through the compensation field of compensating magnets 14, 21, 22, 23. By proper selection of the number, size, distance from the surface 19 of the housing and distance from the edge of the housing of the compensating magnets, it is possible to simultaneously reduce the vertical components of the earth's field in the interior of the housing to an insignificant remainder while simultaneously attaining a good degree of compensation of the magnetic interference fields in the vicinity of the empty housing. If this is the case, after successful compensation of the empty housing of an article or apparatus it is possible to install the additional components, which have been demagnetized in a zero field beforehand, into the housing without significantly altering the degree of compensation.

The horizontal distance between the compensating magnets and the edge of the housing is the decisivie factor for whether a compensating magnet contributes more to weakening the earth's field in the interior of the housing or contributes more to compensation of the magnetic moment of the housing induced from the earth's field. If the horizontal distance between the compensating magnets and the edge of the housing is large, i.e., if the compensating magnet is located more over the central area of surface 19 of the housing, it makes a greater contribution to weakening that portion of the earth's magnetic field which penetrates the housing wall. If, on the other hand, the compensating magnet is located more over the periphery of the housing surface, its contribution toward compensation of the magnetic moment of the housing is greater, as there is a greater magnetized area 20 in the housing wall.

If, with certain types of ferromagnetic engine housings, it is not possible to keep the interior of the compensated empty housing free of the vertical components of the earth's magnetic field, the entire article or apparatus must be treated in a decaying alternating field under the influence of the earth's field after installation of the components in the housing. In order to prevent permanent magnetic poles, which would later result in alternating magnetic fields during operation, from being aged into such moving components as crankshafts, etc., at right angles to their axis of rotation by that part of the earth's magnetic field which penetrates the housing walls, these moving components are slowly rotated during the alternating field treatment. In components which do not move and in those moving components which move in the direction of their axis of rotation, the treatment in the decaying alternating field will cause additional permanent magnetization which will increase the interference field in the vicinity of the apparatus, i.e., which will result in a certain degree of undercompensation. If the above-mentioned diagram concerning the dependence of the degree of compensation on the distances between the compensating magnets and surface 19 of the housing has been made for the empty housing, it is now possible to select that distance between the compensating magnets and surface 19 of the housing which would have resulted in an overcompensation in the empty housing, and which corresponds precisely to the above-mentioned under compensation. This means that the empty housing has been overcompensated just enough so that optimum compensation of the article or apparatus will be attained after installation of the engine components and treatment in the decaying alternating magnetic field.

What was said above applies for the employment of the compensated apparatus at a constant geographical latitude. Should this latitude change during the course of service of the apparatus, e.g., if employed in ships, it is also necessary to take into consideration the alteration of the vertical components of the earth's magnetic field connected therewith. In this case, the magnetic compensation and subsequent treatment in the decaying alternating magnetic field is not only performed under the influence of the earth's magnetic field, but the sequence is repeated, with the vertical component of the earth's magnetic field being artificially varied within the limits of the values to be expected in actual service. Accordingly, the corresponding distances between the compensating magnets and the surface 19 of the housing for optimum compensation are determined for a number of different values of the earth's magnetic field. If the distances so determined are entered in a diagram above the corresponding values of the vertical component of the earth's magnetic field, the necessary distances between the compensating magnets and surface 19 of the housing for optimum compensation can be directly read from the diagram for service in other geographical latitudes.

When treating an article or apparatus in the decaying alternating magnetic field, it is generally necessary to make sure that no magnetic moment resulting from the horizontal components of the earth's magnetic field is produced. This can be avoided through compensation of the horizontal components of the earth's magnetic field with the aid of a coil, cable loop, etc., or by constantly rotating the apparatus on a platform during the magnetic treatment.

Figure 2:
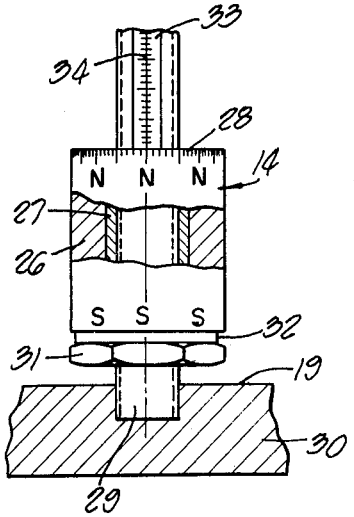
FIG. 2 shows an adjustable compensating magnet with variable distance.

With reference particularly to FIG. 2, there is shown a compensating magnet 14, whose distance from surface 19 of the housing can be adjustably varied. Its major component is an annular permanent magnet 26, which is magnetized axially and whose bore is lined with a threaded brass bushing 27. The upper circumference of the permanent magnet 26, shown partially cut away, contains a scale 28. The permanent magnet is screwed onto a threaded bolt 29, which is also of brass, with the aid of bushing 27. The threaded bolt 29, in turn, is rigidly connected with housing wall 30, forming the surface 19 and a lock nut 31 with washer 32 permits the magnet 26 to be fixed in any desired position. A strip 33 on the upper section of threaded bolt 29 is machined flat and has a scale 34. With the aid of the thread and the two scales 28 and 34, permanent magnet 26 can be precisely and reproduceably set to any desired distance from surface 19 of the housing. Similar results can also be achieved with a bar-shaped permanent magnet if the outside thereof has a thread and it can be slid in a threaded tube of non-ferromagnetic material attached to the housing.

Figure 3:
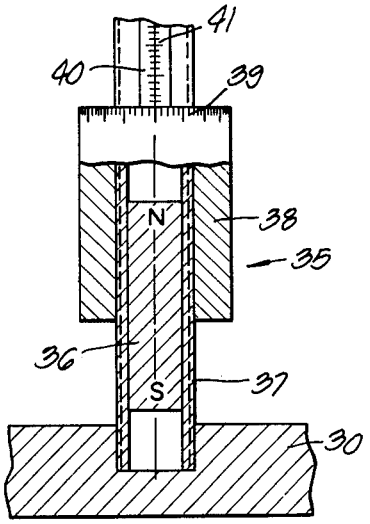
FIG. 3 shows a compensating magnet with variable shunt.

FIG. 3 shows the alternative in which the magnetic shunt of a compensating magnet 35 is altered instead of the distance between compensating magnet and surface 19 of the housing, and which can be otherwise employed analogously in all of the examples described above. A bar-shaped permanent magnet 36 is is securely fixed in the interior of a hollow brass tube 37 which is, in turn, rigidly connected with housing wall 30. The exterior of brass tube is provided with threads and onto which a further tube 38 (shown partially cut away) of ferromagnetic material of high permeability is received. The length of tube 38 corresponds generally to the length of permanent magnet 36 and has on its upper circumference a scale 39. A flat strip 40 is machined on the exterior of brass tube 37 and has a further scale 41. Tube 38 can be shifted over permanent magnet 36 very precisely with the aid of the thread. This causes the magnetic moment of the permanent magnet which is effective on the outside thereof, to be reduced until permanent magnet and the shunting tube 30 are exactly opposite, i.e., until tube 38 represents a complete shunt of permanent magnet 36 and the magnetic moment of compensating magnet 35 reaches its minimum. The setting of the magnetic shunt can be read very exactly on the two scales 39, 41. A compensating magnet which acts in a similar manner can also be realized with an annular permanent magnet if a ferromagnetic threaded bolt is provided in the interior thereof as a magnetic shunt.

It is by no means always necessary to equip all compensating magnets with a variable magnetic moment. Frequently, several or only a single compensating magnet with variable magnetic moment are or is sufficient, while the remainder of the compensating magnets can have a fixed magnetic moment.

I claim:

1. A method for stable compensation of the magnetic interference fields produced by the vertical component of the earth's magnetic field in the vicinity of an article including a housing and components therein in which a compensation moment opposite to the magnetic moment induced in the article by the vertical component is produced and the article is also subjected to a vertically directed alternating magnetic field with decaying amplitude, which comprises the steps of:

locating at least one permanent magnet adjacent an outer surface of the article;

adjusting the magnetic moment induced in the article by the permanent magnet to compensate for the effect thereon of the earth's magnetic field vertical component; and subjecting the article to an alternating magnetic field with decaying amplitude.

2. A method as in claim 1, in the adjustment of the permanent magnetic moment induced in the article is produced by varying the distance of the magnetic from the housing outer surface.

3. A method as in claim 1, in which adjustment of the permanent magnet moment induced in the article is accomplished by shunting the magnet.

4. A method as in claim 1, including the further step of:

positioning a plurality of compensating magnets about the housing to provide a housing interior generally free of the vertical components of the earth's magnetic field, into which the further components of the apparatus are subsequently installed.

5. A method as in claim 1, in which:

the further components of the article are then installed in the housing; and the compensation and alternating field treatment are repeated after a previous overcompensation has been provided through appropriately locating and adjusting compensating magnets adjacent the housing, the overcompensation precisely offsetting the undercompensation as a result of the installation of the components.

6. A method as in claim 5, in which during the treatment of the article with the components built into the housing, rotatable components are slowly rotated.

7. A method as in claim 1, in that during the treatment in the decaying alternating magnetic field, horizontal components of the earth's magnetic field are offset in the area of the article through the opposing field of a coil or cable loop.

8. A method as in claim 1, in that during the treatment in the decaying alternating magnetic field, the article is rotated slowly about a vertical axis.

9. A method as in claim 8, in which the matching values for setting the compensating magnets for the other geographical latitudes are taken from previously determined values, and the settings of the compensating magnets for optimum compensation are obtained by artificially altered vertical components of the earth's magnetic field.

10. Apparatus for inducing a selective magnetic moment in an article to compensate for the effect of an external magnetic field, comprising:

a threaded bolt of non-magnetic material, an end of which is affixed to the outer surface of said article; and an internally threaded annular magnet received on said bolt and adjustable therealong to vary the relative spacing of said magnet from said article outer surface.

11. Apparatus as in claim 10, in which scale graduations are provided on said bolt and said magnet.

12. Apparatus as in claim 10, in which threaded tubular means of a non-magnetic material interrelates the magnet and the bolt.

13. Apparatus for inducing a selective magnetic moment in an article to compensate for an external magnetic field, comprising:

a hollow tube of non-magnetic material, one end of which is for attachment to said article;

an elongated magnet fixedly located within said tube; and a ferromagnetic body having an opening therethrough receiving said tube therein and adjustable along said tube for shunting said magnet.

14. Apparatus as in claim 13, in which said ferromagnetic body has the opening walls threaded for coacting with threads on the tube.

15. Apparatus as in claim 13, in which scale graduations are provided on said tube and said ferromagnetic body.

* * * * *